US006913408B2

(12) United States Patent
Tsujino

(10) Patent No.: US 6,913,408 B2
(45) Date of Patent: Jul. 5, 2005

(54) FILE AND BINDING MEMBER

(75) Inventor: Nobuaki Tsujino, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 3 days.

(21) Appl. No.: 10/724,619

(22) Filed: Dec. 2, 2003

(65) Prior Publication Data

US 2004/0141800 A1 Jul. 22, 2004

(30) Foreign Application Priority Data

Jan. 22, 2003 (JP) ..... P2003-014067
Sep. 30, 2003 (JP) ..... P2003-342163

(51) Int. Cl.[7] ..... B42F 3/00
(52) U.S. Cl. ..... 402/70; 402/19; 402/73; 402/80 R; D19/26
(58) Field of Search ..... 402/5, 19, 23, 402/70, 73, 35, 80 R, 500, 502; D19/26, 27

(56) References Cited

U.S. PATENT DOCUMENTS

| | | | | | |
|---|---|---|---|---|---|
| 1,507,547 | A | | 9/1924 | Grunewald | |
| 3,275,005 | A | | 9/1966 | Cott | |
| 5,642,954 | A | * | 7/1997 | Hudspith | 402/36 |
| 5,683,193 | A | * | 11/1997 | Cerri | 402/20 |
| 5,971,650 | A | * | 10/1999 | Dottel | 402/73 |
| 6,220,775 | B1 | * | 4/2001 | Dottel | 402/73 |
| 6,761,497 | B2 | * | 7/2004 | Kaneda | 402/31 |
| 2004/0141800 | A1 | * | 7/2004 | Tsujino | 402/73 |

FOREIGN PATENT DOCUMENTS

| | | |
|---|---|---|
| JP | 01-115599 | 5/1989 |
| JP | 01-244897 | 9/1989 |
| JP | 02-076799 | 3/1990 |
| JP | 2000-343867 | 12/2000 |
| JP | 2002-178678 | 6/2002 |
| WO | WO 01-43980 | 6/2001 |

* cited by examiner

*Primary Examiner*—Monica S. Carter
(74) *Attorney, Agent, or Firm*—Banner & Witcoff Ltd.

(57) ABSTRACT

In order to provide a ring file that can preferably file much more sheet of papers or leaves, a file wherein a binding member 1 constituting a ring-shaped body to file papers or leaves is mounted on a cover sheet body 2 is so arranged that a pair of hinges are arranged at predetermined positions of the ring-shaped body and a portion 112 of the rig-shaped body locating ahead of the hinge can be inclined.

28 Claims, 13 Drawing Sheets

FILE AND BINDING MEMBER

BACKGROUND OF THE INVENTION AND RELATED ART STATEMENT

This invention relates to a file and a binding member for filing papers or leaves.

A file for filing papers or leaves, in other words, refills or other variety of materials as sort of a sheet has been used extensively. Widely known is a file so called a ring file in which a binding member constituting a ring-shaped body is mounted on a cover sheet body, for example, described in the following patent document 1 or the following patent document 2. The file is established by connecting a base portion from which an openable and closable ring-shaped body stands with an inner face of a rear cover sheet.

Patent document 1: Patent laid open No. 2002-178678

Patent document 2: Patent laid open No. 2000-343867

SUMMARY OF THE INVENTION

For the above-mentioned file, a maximum number of the papers or leaves that can be filed is regulated by a width of a scroop of the cover sheet body. Practically, however, it is not possible to file papers or leaves of a volume equal to the width of the scroop. In most cases, since a distal end side, namely, a front cover sheet side of the ring-shaped body of the binding member is curved or bent so as to form an arch shape, a maximum number of the papers or leaves that can be filed is regulated by a length of the binding member locating at a proximal end side, namely at a rear cover sheet side behind the arch shape. Further, the ring-shaped body is usually openable and closable, a maximum number of the papers or leaves that can be filed is regulated by a position where the ring-shape body opens or closes. In addition, if the ring-shaped body is formed so as to be accommodated within a width of the scroop, the maximum number of the papers or leaves that can be filed decreases. It is a matter of course that a size of the ring-shaped body can be made to be large enough to increase the maximum number of the papers or leaves that can be filed. With this arrangement, however, a distal end portion side of the ring-shaped body might protrude from the front cover sheet and the protruded portion of the ring-shaped body might interfere other file, resulting in some trouble in storing files, for example, when a plurality of files are laid side by side.

In consideration of the above problems the present claimed invention intends to provide a ring file and a binding member that can preferably file more sheets of papers or leaves.

In order to solve the above problems, the present claimed invention is a file in which a binding member constituting a ring-shaped body to file papers or leaves is mounted on a cover sheet body and a pair of hinges are arranged at predetermined positions of the ring-shaped body and a portion ahead of the hinges of the ring-shaped body can be inclined. In accordance with the arrangement, the ring-shaped body can be made large so as to be able to file a necessary number of papers or leaves and the ring-shaped body will not disturb filing the papers or leaves if a distal end side of the ring-shaped body is folded as required.

For the ring-shaped body comprising a pair of openable and closable ring chips wherein each distal end portion of the ring chips is engaged to close a space between the ring chips, if a first hinge is arranged on one of the ring chips and an engaging arrangement to engage each distal end portion of the ring chips in a relatively rotatable manner is established to be a second hinge, an arrangement of the ring-shaped body can be avoided from being complicated.

More concretely, it is preferable that the engaging arrangement is so arranged that at the distal end portion of one ring chip formed is a projecting portion that projects toward the distal end portion of the other ring chip when the space between the ring chips is closed, at the distal end portion of the other ring chip formed is an axial hole that accommodates the projecting portion when the space between the ring chips is closed, and each distal end portion of the ring chips is relatively rotatable by a concavo-convex engagement of the projecting portion and the axial hole by making use of the projecting portion as a rotational axis and the axial hole as a bearing.

Further, if a notch is formed by cutting off at least a part of an inner face of the axial hole so that an opening edge of the axial hole expands toward a direction to which the ring chips open or close, the projecting portion can be easily guided to the axial hole when the space between the ring chips is closed and the projecting portion can be easily separated from the axial hole when the space between the ring chips is opened.

In order to make it possible to position the projecting portion inserted into the axial hole preferably when the space between the ring chips is closed, it is preferable that a distal end portion of the projecting portion is treated to be sphere.

In order to make it possible to guide the projecting portion into the axial hole preferably when the space between the ring chips is closed, it is preferable that a radius face in a partial sphere shape is formed at a projecting end of one of the ring chips and if a radius face in a partial sphere shape is formed at a projecting end of the ring chips, a binding hole is difficult to get stuck with the second hinge when dealing with papers or leaves.

In addition, in order to make it possible to lock the hinge at a certain angle it is preferable that a stopper is further provided to retain an angle of the hinge. In accordance with this arrangement, a situation such that the distal end portion ahead of the hinge of the ring-shaped body is unexpectedly inclined or stands unexpectedly so as to hook other file or the like can be avoided and papers or leaves can be stored effectively and handled preferably as well.

In order to set the angle to lock the hinge appropriately it is preferable that the stopper consists of a pushing portion arranged on one of the members constituting the ring-shaped body through the hinges and a surface of the other member on which a concave portion is arranged, and the pushing portion retains the angle of the hinges by being inserted into the concave portion with applying a pushing force to the surface of the other member. In accordance with this arrangement, it is possible to set an angle of locking the hinge at discretion by appropriately setting the position of the concave portion. In addition, when a force above a certain level is applied in a locked state, the pushing portion makes a sliding movement on the surface of the other member and deflects from the concave portion and then a locked state is released. In accordance with the arrangement, it is possible for a user to lock or unlock the hinge preferably.

In order to lock the hinge in an orthotropic state it is preferable that the stopper has the concave portion at the end portion of the other member and retains the angle of the hinges in an orthotropic state by inserting the pushing portion into the concave portion.

In order to make it possible to set a specification of the stopper at discretion it is preferable that the pushing portion consists of an elastic member and an abutting member, wherein one portion of the elastic member is fixed to a predetermined position of one of the members and the other portion of the elastic member supports the abutting member and the abutting member makes an abutting contact with the other member. In accordance with this arrangement, it is possible to set an elastic strength of the elastic member and a shape of the abutting member appropriately. Further strength to hold the hinge can be set appropriately by setting a position and a shape of the concave portion arranged on the other member appropriately. More concretely, it is preferable that the elastic member consists of a coiled spring and the abutting member consists of a spherical body.

In addition, if the ring-shaped body comprises a pair of standing post portions extending generally vertically to a mounting face of the cover sheet body on which the binding member is mounted and a curved or bent arch portion arranged to connect each distal end of the standing post portions, and a hinge is arranged at each of a connected portion of the standing post portion portion and the arch portion respectively, the hinge will not disturb filing papers or leaves.

If at least one of the standing post portions extends in a linear manner, it is possible to file papers or leaves preferably by making use of the standing post portions.

If the cover sheet body includes a rear cover sheet on an inner face of which the binding member is mounted, a scroop continuing to the rear cover sheet and a front cover sheet continuing to the scroop and facing to the rear cover sheet, and a pair of the hinges are arranged at a position separated from the inner face of the rear cover sheer by a distance generally corresponding to a width of the scroop, it is possible to file papers or leaves of numbers whose thickness corresponds to a width of the scroop.

In addition, if an opening that allows a portion of the ring-shaped body ahead of the hinge to pass when the portion ahead of the hinge of the ring-shaped body is not inclined and that prevents the portion ahead of the hinge of the ring-shaped body from passing when the portion is inclined is formed on the front cover sheet, it is possible to prevent the cover sheet body from opening by inclining the portion ahead of the hinge of the ring-shaped body when the cover sheet body is folded and closed.

DETAILED DESCRIPTION OF THE PREFERRED EMBODIMENTS

Figure 1:
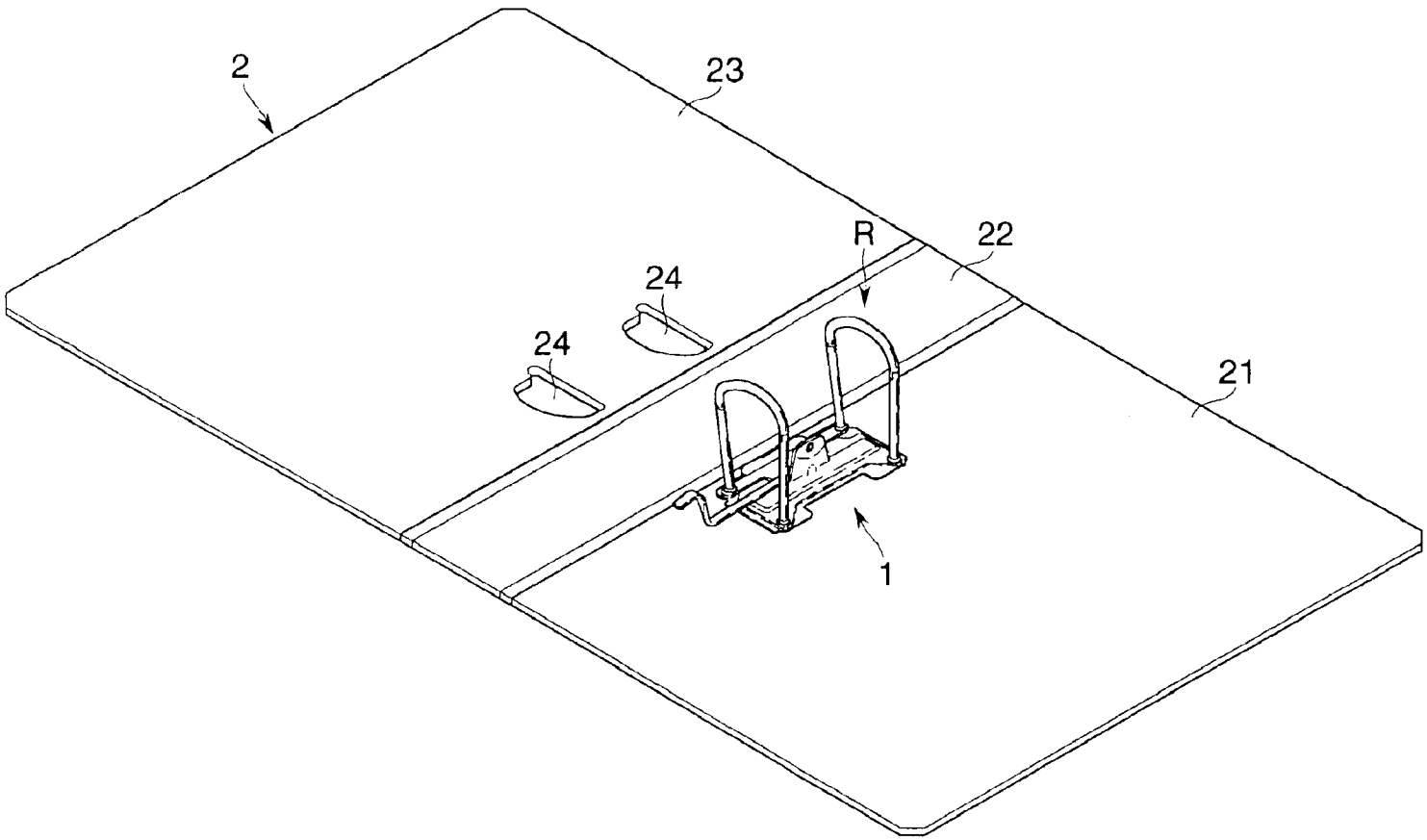
FIG. 1 is a general perspective view of a file in accordance with one embodiment of the present claimed invention.
Figure 2:
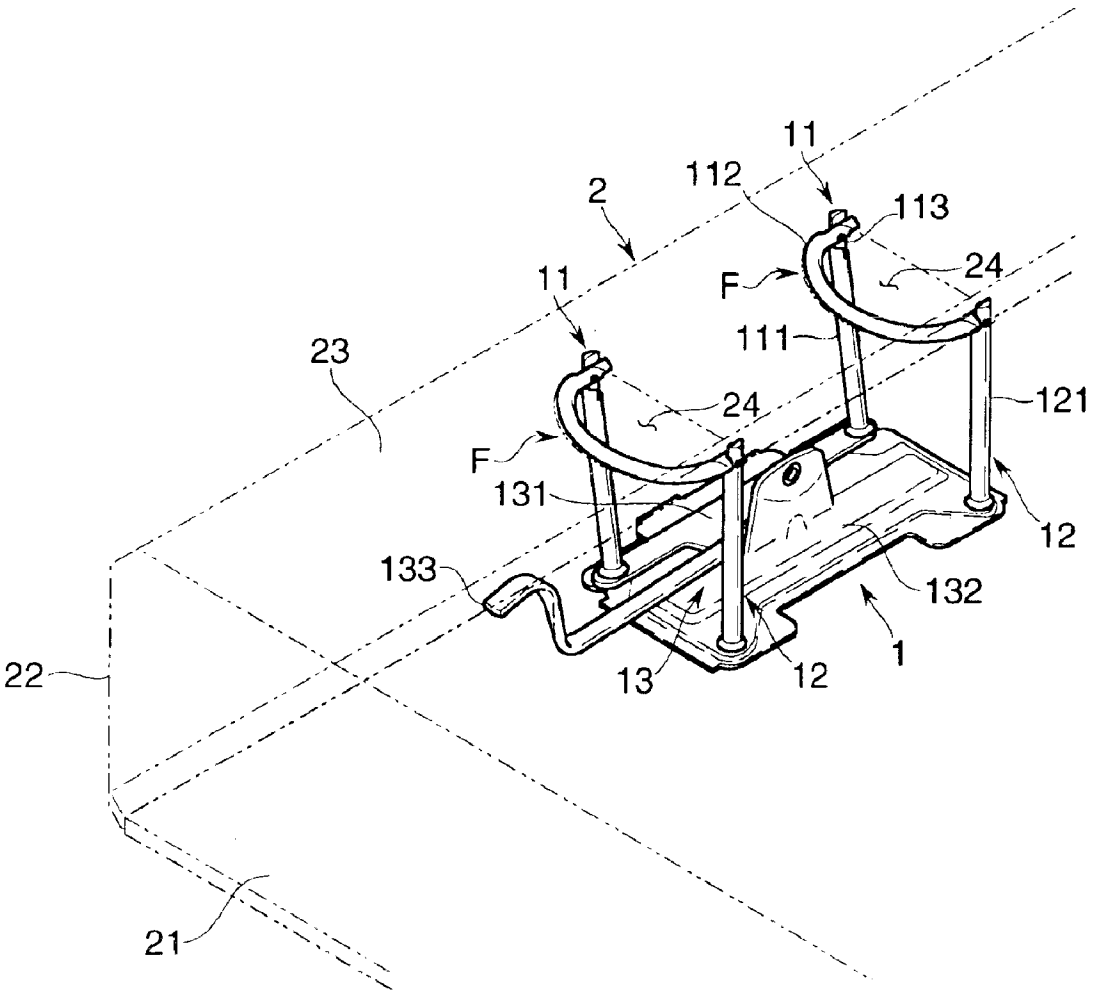
FIG. 2 is a perspective view of a part of the file.
Figure 3:
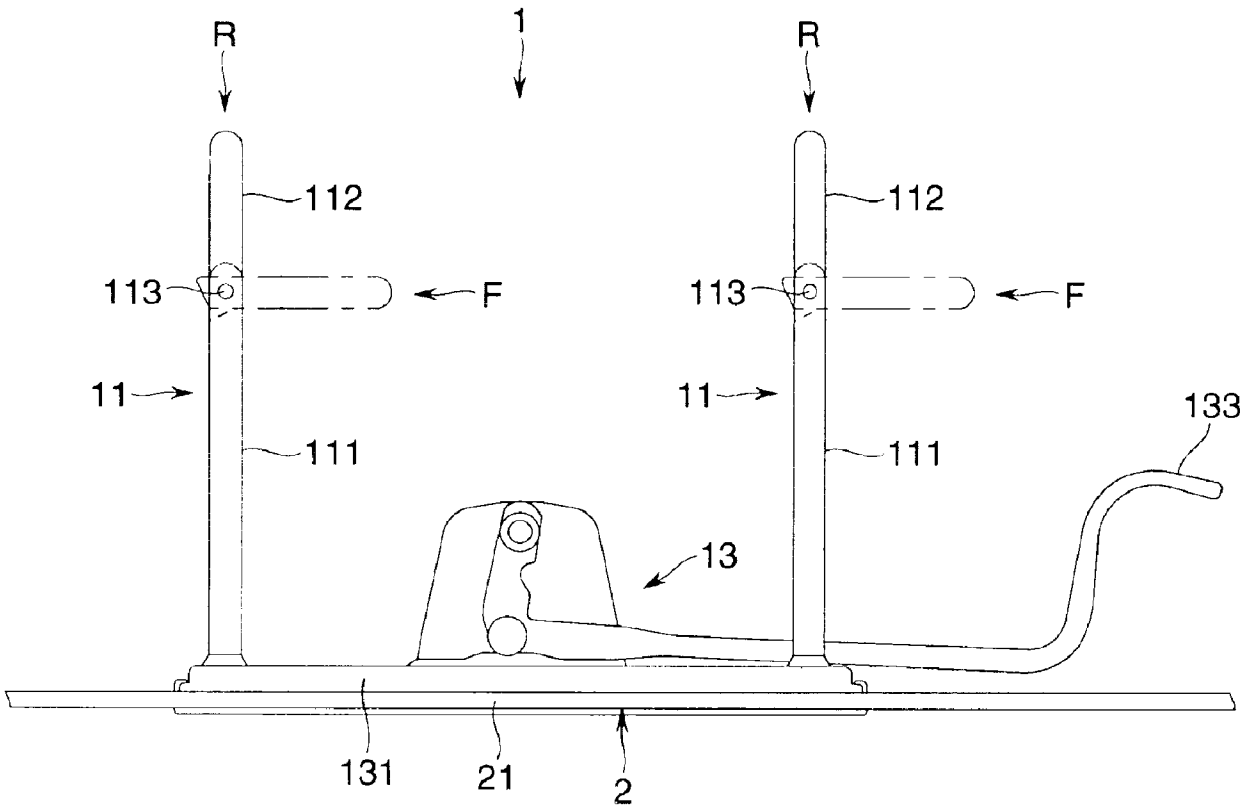
FIG. 3 is a side view of a part of the file.
Figure 4:
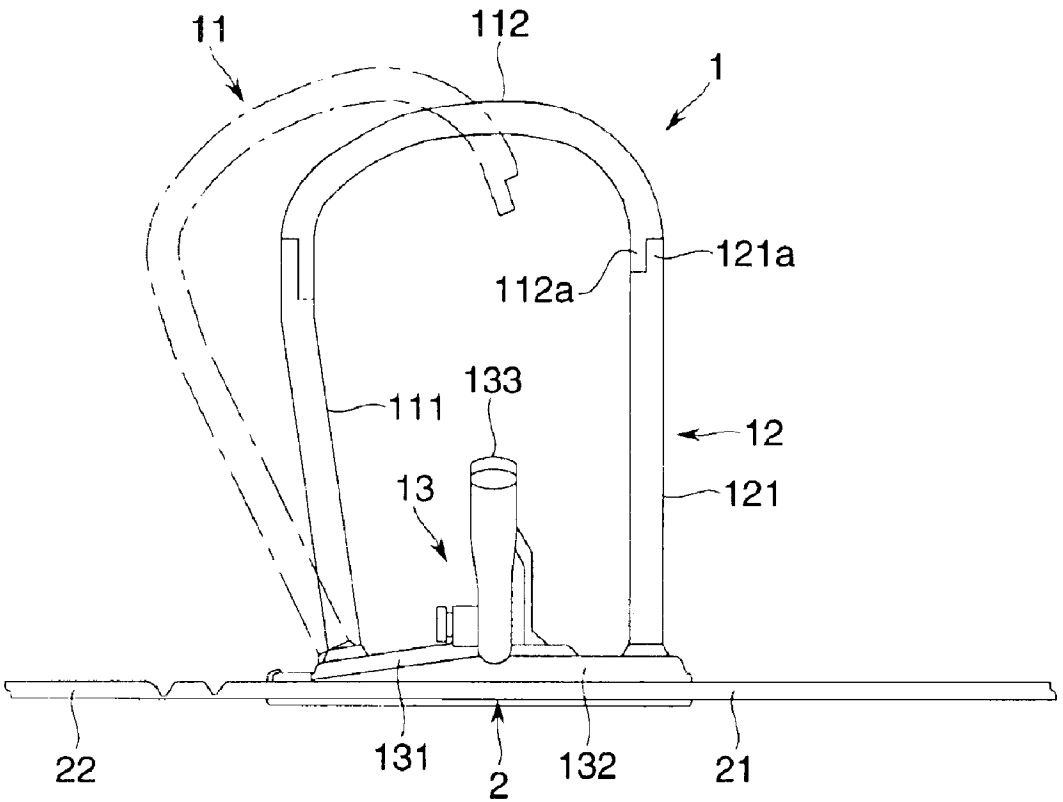
FIG. 4 is a plane view of a part of the file.

An embodiment of the invention will be described in detail with reference to the accompanying drawings. FIG. 1 through FIG. 4 show a file in accordance with the embodiment of the present claimed invention. The file is so arranged that a binding member 1 is mounted on a cover sheet body 2.

The cover sheet body 2 is, for example, integrally formed with a rear cover sheet 21, a scroop 22 continually formed with a side edge of the rear cover sheet 21 and a front cover sheet 23 continually formed with a side edge of the scroop 22. The binding member 1 is mounted on an inner face of the rear cover sheet 21 of the cover sheet body 2 near the scroop 22. An opening 24 formed on the front cover sheet 23 will be described later.

The binding member 1 constitutes a ring-shaped body to file papers or leaves. The binding member 1 comprises a pair of ring chips 11, 12 and an open-close mechanism 13 that makes it possible to open or close a space between a distal end portion of the ring chip 11 and a distal end portion of the ring chip 12. A pair of the ring chips 11, 12 form a general U-shape standing generally vertically from the inner face of the rear cover sheet 21 as a face on which the binding member 1 is mounted in plane view in a condition that the space between the ring chips 11 and 12 is closed so as to be a primary constituting element of the ring-shaped body. Each of a pair of the ring chips 11, 12 projects from a base plate 131 or 132 respectively. A pair of the base plates 131 and 132 each of which is separately formed are combined each other in a relatively rotatable manner at each side edge portions near the scroop 22. The open-close mechanism 13 that opens or closes the space between the ring chip 11 and the ring chip 12 comprises mainly a pair of the base plate 131, 132. More specifically, when the base plate 131 makes a rotary movement around the side edge portion of the base plate 131 so as to be separated from other base plate 132, the space between the distal end portion of the ring chip 11 and the distal end portion of the ring chip 12 opens. When the base plate 131 makes a reversed rotary movement so as to overlap with the other base plate 132, the space between the distal end portions of the ring chips 11, 12 closes. A pre-load is previously applied toward a direction so as to separate the base plate 131 from the base plate 132 by an urging means (not shown in drawings) such as a spring. The base plate 131 is rotated, for example, by operating an operating lever 133 with an up and down movement. The open-close mechanism 13 is not limited to the above-described embodiment and may be any other existing mechanism. For example, a pair of the ring chips 11, 12 may be so arranged that a proximal end portion of the ring chip 11 is fixed to a base plate and a proximal end portion of other ring chip 12 is rotatably mounted on the base plate through a bearing, and a part of the proximal end portion of the ring chip 12 is provided with a portion displaced from a rotational axis of the ring chip 12 and the part is urged by a leaf spring.

Figure 5:
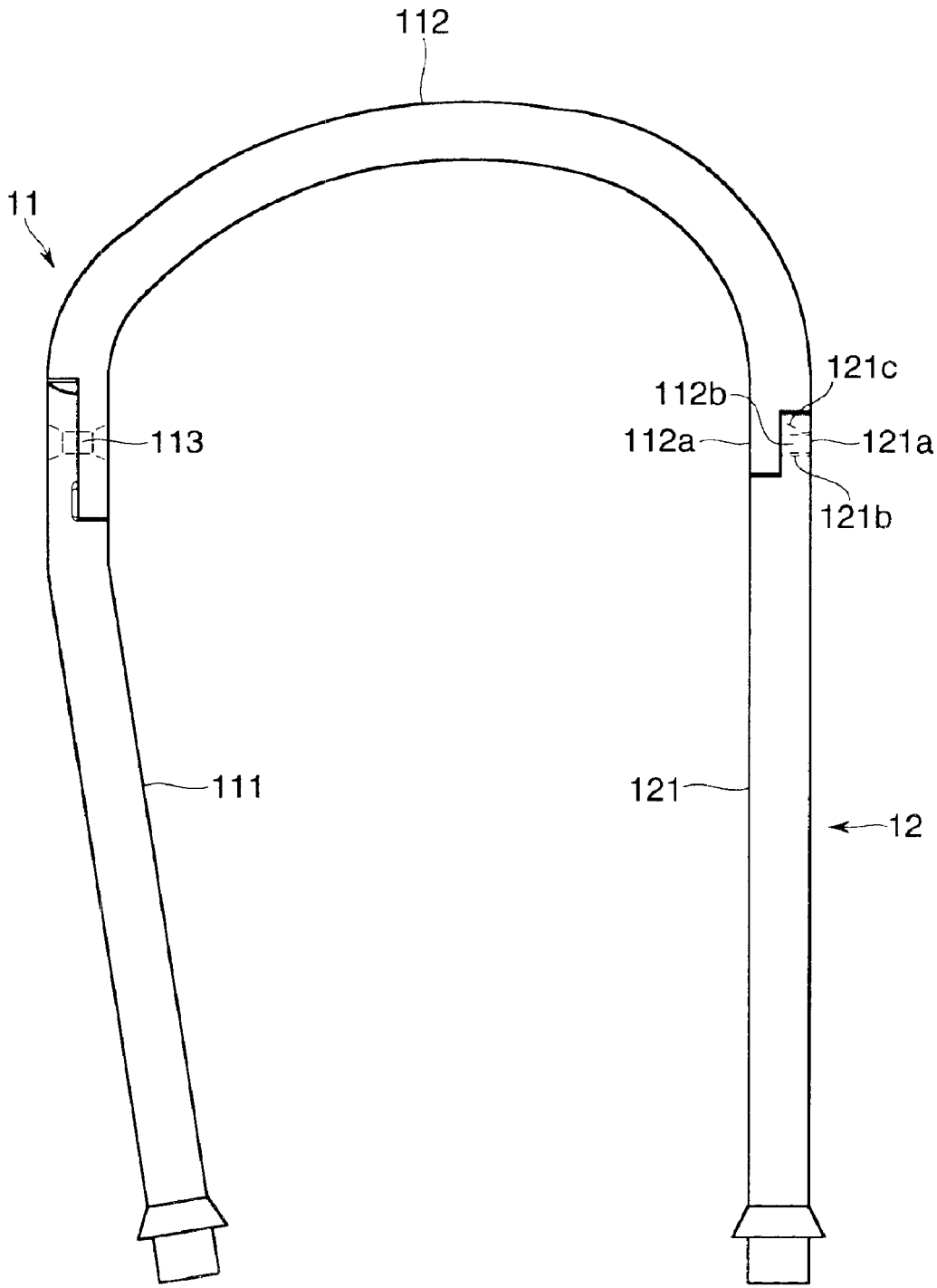
FIG. 5 is a plane view of a ring-shaped body constituting a binding member.
Figure 7:
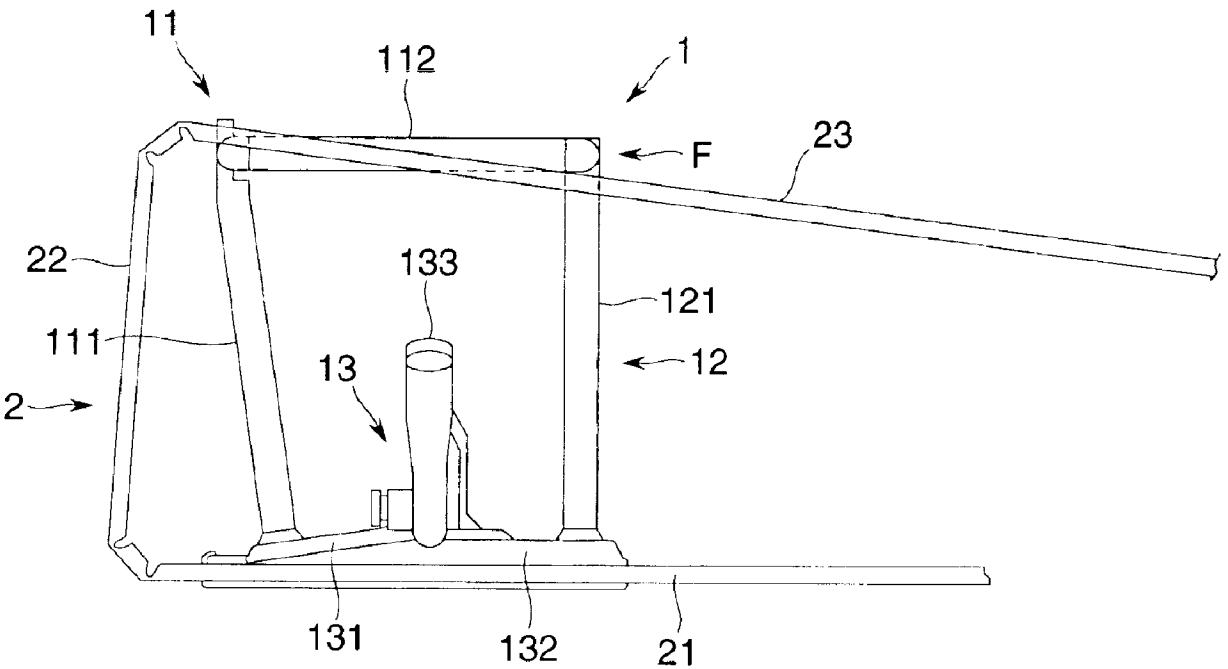
FIG. 7 is a plane view of a part of the file.

As shown in FIG. 5, the first ring chip 11 as one of the ring chips 11, 12 comprises a standing post portion 111 whose proximal end is fixed to the base plate 131 and an arch portion 112 extending out from a distal end of the standing post portion 111. The standing post portion 111 is in a general cylinder and extends generally vertical (strictly speaking, a little inclined toward the scroop 22 in plane view) to the inner face of the rear cover sheet 21 when the space between both of the ring chips 11 and 12 is closed. The arch portion 112 is a curved arch-shaped member whose cross-sectional view is a circle. The distal end of the standing post portion 111 and a proximal end of the arch portion 112 are starvedjointed. The distal end of the standing post portion 111 and the proximal end of the arch portion 112 are connected with inserting a pin 113 that passes through an overlapped portion of the standing post portion 111 and the arch portion 112. The distal end of the standing post portion 111 and the arch portion 112 are relatively rotatable around the pin 113. Namely, a first hinge is established by interposition of the pin 113. An axial direction of the pin 113 is generally parallel to the inner face of the rear cover sheet 21 when the space between the ring chips 11 and 12 is closed. As a result of this, as shown in FIG. 7, the arch portion 112 can take both a standing position R wherein the arch portion 112 exists on generally the same plane as that of the standing post portion 111 and the standing post portion 111 and the arch portion 112 form a J-shape in plane view and an inclined position F wherein the arch portion 112 is rotated approximately 90 degrees from the standing position R so as to be generally parallel to the inner face of the rear cover sheet 21.

The second ring chip 12 as other ring chip comprises a standing post portion 121 whose proximal end is fixed to the base plate 132. The standing post portion 121 is in a general cylinder and extends in a linear manner generally vertical to the inner face of the rear cover sheer 21 when the space between both of the ring chips 11 and 12 is closed. The standing post portion 121 of the second ring chip 12 locates at a lateral side, namely, an inverse side to the scroop 22 of the standing post portion 111 of the first ring chip 11. Usually in order to file papers and leaves in the file, the standing post portion 121 of the second ring chip 12 is inserted into the papers or leaves to be filed and then the space between the first and the second ring chips 11 and 12 is closed.

Figure 6:
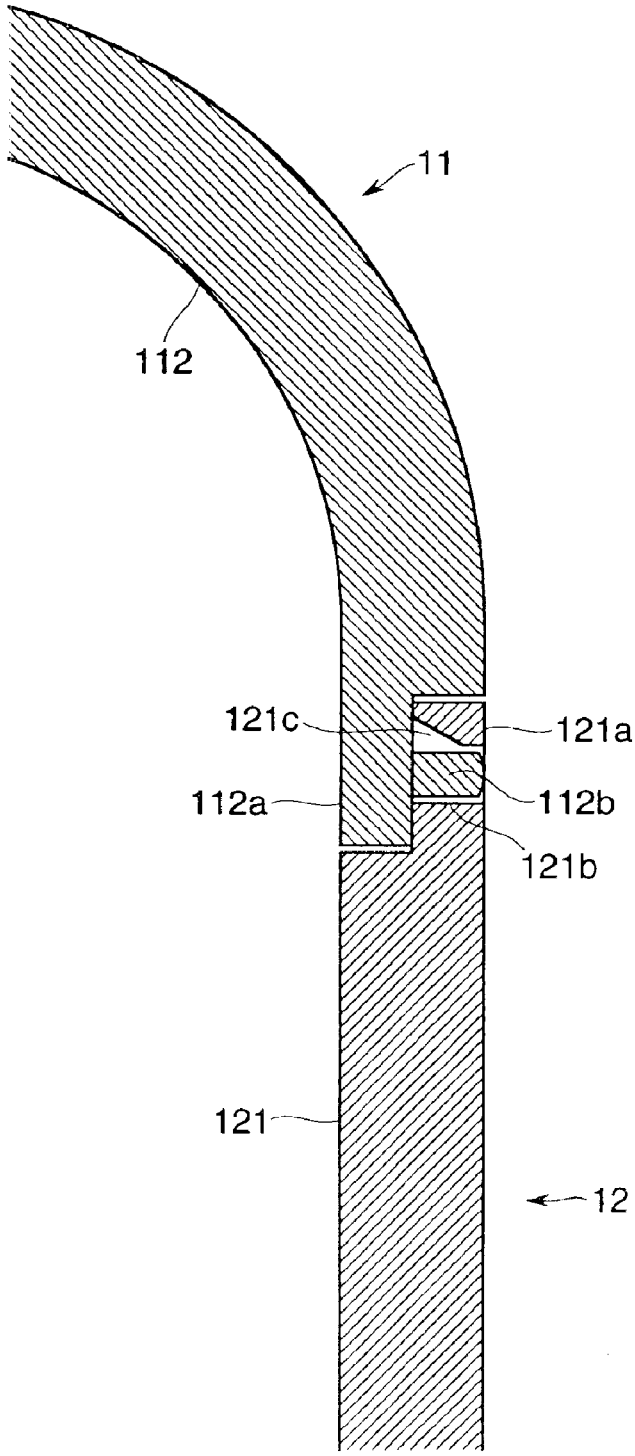
FIG. 6 is a cross-sectional view of a part of the ring-shaped body.

As shown in FIG. 6, a distal end of the arch portion 112 of the first ring chip 11 has a projecting end 112*a* relatively projecting toward an extending direction that is formed by cutting off one side end of the distal end thereof. A distal end of the standing post portion 121 of the second ring chip 12 also has a projecting end 121*a* relatively projecting toward an extending direction that is formed by cutting off one side end of the distal end thereof. A projecting portion 112*b* whose shape is generally a cylinder is formed at a side face of one of the projecting ends (the projecting end 112*a* locating at a distal end of the arch portion 112 in this embodiment). The projecting portion 112*b* is not limited to a shape of a cylinder, and it may be a shape of a cone. It is preferable that the projecting portion 112*b* projects toward the inverse side to the scroop 22. In addition, an axial hole 121*b* that can accommodate the projecting portion 112*b* is formed at a side face of the other projecting end (the projecting end 121*a* locating at the distal end of the standing post portion 121). In this embodiment, a notch 121*c* is formed by cutting off at least a part of an inner face of the axial hole 121*b* so that an opening edge of the axial hole 121*b* formed on the projecting end 121*a* expands toward a direction to which the ring chips 11 and 12 open or close. In this embodiment formed is the tapered notch 121*c* that inclines from a predetermined portion on an inner face of the axial hole 121*b* formed on the projecting end 121*a* of the standing post portion 121 toward an extending direction of the standing post portion 121, in other words, that inclines toward a direction of the arch portion 112. Then when the space between the ring chips 11 and 12 is closed, the distal end of the arch portion 112 moves along a direction to which the ring chips 11 and 12 open or close so as to approach the distal end of the standing post portion 121. In this case, the projecting end 112*a* locating at the distal end of the arch portion 112 overlaps with the projecting end 121*a* locating at the distal end of the standing post portion 121 and the projecting portion 112*b* formed at the projecting end 112*a* is accommodated into the axial hole 121*b* formed at the projecting end 121*a*. In case that the projecting portion 112*b* and the axial hole 121*b* make a concavo-convex engagement as mentioned above, the distal end of the arch portion 112 as the distal end portion of the first ring chip 11 and the distal end of the standing post portion 121 as the distal end portion of the second ring chip 12 are relatively rotatable by making use of the projecting portion 112*b* as a rotational axis and the axial hole 121*b* as a bearing. In other words, an engaging arrangement established by the concavo-convex engagement comprising the projecting portion 112*b* and the axial hole 121*b* is to be a second hinge. An axial direction of the projecting portion 112*b* and an axial center direction of the axial hole 121*b* are generally parallel to the inner face of the rear cover sheet 21 when the space between the ring chips 11 and 12 is closed. As a result of this, the arch portion 112 can take both a standing position R wherein the arch portion 112 exists on generally the same plane as that of the standing post portion 121 and an inclined position F wherein the arch portion 112 is rotated approximately 90 degrees from the standing position R so as to be generally parallel to the inner face of the rear cover sheet 21.

As mentioned above, each distal end of a pair of the standing post portions 111, 121 is connected with the arch portion 112 so as to form the ring-shaped body. A portion of the ring-shaped body ahead of the hinge, namely, the arch portion 112 is so arranged to be inclinable if necessary. A shape and a size of the standing post portion 111, 121 are so set that each distal end of a pair of the standing post portion 111, 121 locates separated from the inner face of the rear cover sheet 21 by a distance generally corresponding to a width of the scroop 22 when the space between the ring chips 11 and 12 is closed. In other words, a pair of the hinges locate at a position separated from the inner face of the rear cover sheer 21 by a distance generally corresponding to a width of the scroop 22 when the space between the ring chips 11 and 12 is closed.

Figure 8:
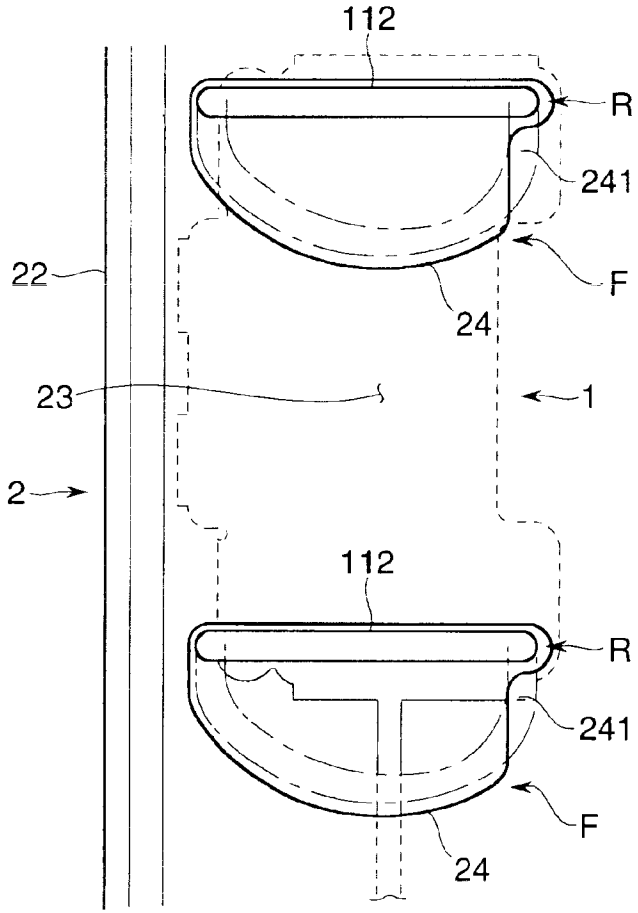
FIG. 8 is a partial front view showing an opening to be formed on the front cover sheet.

In addition, in this embodiment as shown in FIG. 8, an opening 24 is arranged on the front cover sheet 23. A shape of the opening 24 is so formed that the arch portion 112 is included in a front view in the standing position R when the arch portion 112 is not inclined and at least a part of the arch portion 112 is not included in a front view in the inclined position F when the arch portion 112 is inclined. In other words, the opening 24 is so formed that the arch portion 112 is allowed to pass through the opening 24 smoothly when the arch portion 112 is not inclined, while the arch portion 12 is not allowed to pass through the opening 24 smoothly when the arch portion 112 is inclined. More specifically, a part of an opening edge of the opening 24 generally corresponding to the inclined arch portion 112 in a front view protrudes inward to form a tongue 241 and the tongue 241 blocks the arch portion 112 from passing through the opening 24 by making an abutting contact with a predetermined portion of the inclined arch portion 112. The tongue 241 is formed, for example, in an area of the inverse side to the scroop 22 of the opening 24. With this arrangement, it is possible to effectively prevent the cover sheet body 2 from opening improperly by a process of folding the cover sheet body 2 so as to approach the rear cover sheet 21 to the front cover sheet 23 in a condition the arch portion 112 is not inclined, followed by a process of inclining the arch portion 112. In order to access the filed papers or leaves, to file papers or leaves or to remove filed papers or leaves, the front cover sheet 23 may be opened after the arch portion 112 is rotated to the standing position R.

With this embodiment, since the file in which the binding member 1 constituting the ring-shaped body to file papers or leaves is mounted on the cover sheet body 2 is so arranged that a pair of the hinges are arranged at the predetermined position of the ring-shaped body and the arch portion 112 as the portion ahead of the hinge of the ring-shaped body can be inclined, the ring-shaped body can be made large, namely a length of the stand post portions 111, 112 is elongated so as to be able to file a necessary number of papers or leaves and the ring-shaped body will not disturb filing the papers or leaves if the arch portion 112 locating at a distal end side of the ring-shaped body is folded as required.

Since the ring-shaped body is so arranged to comprise a pair of openable and closable ring chips 11, 12 wherein each distal end portion of the ring chips 11, 12 is engaged to close the space between the ring chips 11 and 12, the first hinge is arranged on one of the ring chips and the engaging arrangement to engage each distal end portion of the ring chips 11, 12 in a relatively rotatable manner is established to be a second hinge, an arrangement of the ring-shaped body can be avoided from being complicated.

since the engaging arrangement is so arranged that at the distal end portion of one ring chip formed is the projecting portion 112*b* that projects toward the distal end portion of the other ring chip when the space between the ring chips 11 and 12 is closed, at the distal end portion of the other ring chip formed is the axial hole 121*b* that accommodates the projecting portion 112*b* when the space between the ring chips 11 and 12 is closed, and each distal end portion of the ring chips 11 and 12 is relatively rotatable by the concavo-convex engagement of the projecting portion 112*b* and the axial hole 121*b* by making use of the projecting portion 112*b* as a rotational axis and the axial hole 121*b* as a bearing, it is possible to integrally form the engaging arrangement for closing the space between the distal end portions of the rings chips 11, 12 and the second hinge, thereby to simplify the arrangement and to reduce a number of components.

Further, since the notch 121*c* is formed by cutting off at least a part of an inner face of the axial hole 121*b* so that the opening edge of the axial hole 121*b* expands toward the direction to which the ring chips 11, 12 open or close, the projecting portion 112*b* can be easily introduced to the axial hole 121*b* when the space between the ring chips 11, 12 is closed and the projecting portion 112*b* can be easily separated from the axial hole 121*b* when the space between the ring chips 11, 12 is opened.

In addition, since the ring-shaped body comprises a pair of the standing post portions 111, 121 extending generally vertically to the mounting face of the cover sheet body 2 on which the binding member 1 is mounted and the curved or bent arch portion 112 arranged to connect each distal end of the standing post portions 111, 121, and the hinge is arranged at boundaries between each standing post portions 111 and 112 and the arch portion 112 respectively, the hinge will not disturb filing papers or leaves.

Since at least the standing post 121 of the second ring chip 12 that is one of the standing post portions 111, 121 extends in a linear manner, it is possible to file papers or leaves preferably by making use of the standing post 121.

Since the cover sheet body 2 includes the rear cover sheet 21 on the inner face of which the binding member 1 is mounted, the scroop 22 continuing to the rear cover sheet and the front cover sheet 23 continuing to the scroop 22 and facing to the rear cover sheet 21, and a pair of the hinges are arranged at a position separated from the inner face of the rear cover sheer 21 by a distance generally corresponding to the width of the scroop 22, it is possible to file papers or leaves of numbers whose thickness corresponds to the width of the scroop 22.

In addition, since the opening 24 that allows the arch portion 112 ahead of the hinge to pass when the portion ahead of the hinge is not inclined and that prevents the arch portion 112 ahead of the hinge from passing when the arch portion 112 is inclined is formed on the front cover sheet 23, it is possible to prevent the cover sheet body 2 from being opened by inclining the portion locating ahead of the hinge when the cover sheet body 2 is folded and closed.

Next another embodiment of the present claimed invention will be explained with referring to the drawings. A same reference numeral will be given to a component corresponding to the component of the above-described embodiment and an explanation will be omitted.

A file in accordance with another embodiment of the present claimed invention is shown in FIG. 9 through FIG. 13. The file is so arranged that a binding member 10 for binding papers or leaves is mounted on a cover sheet body 2.

Figure 9:
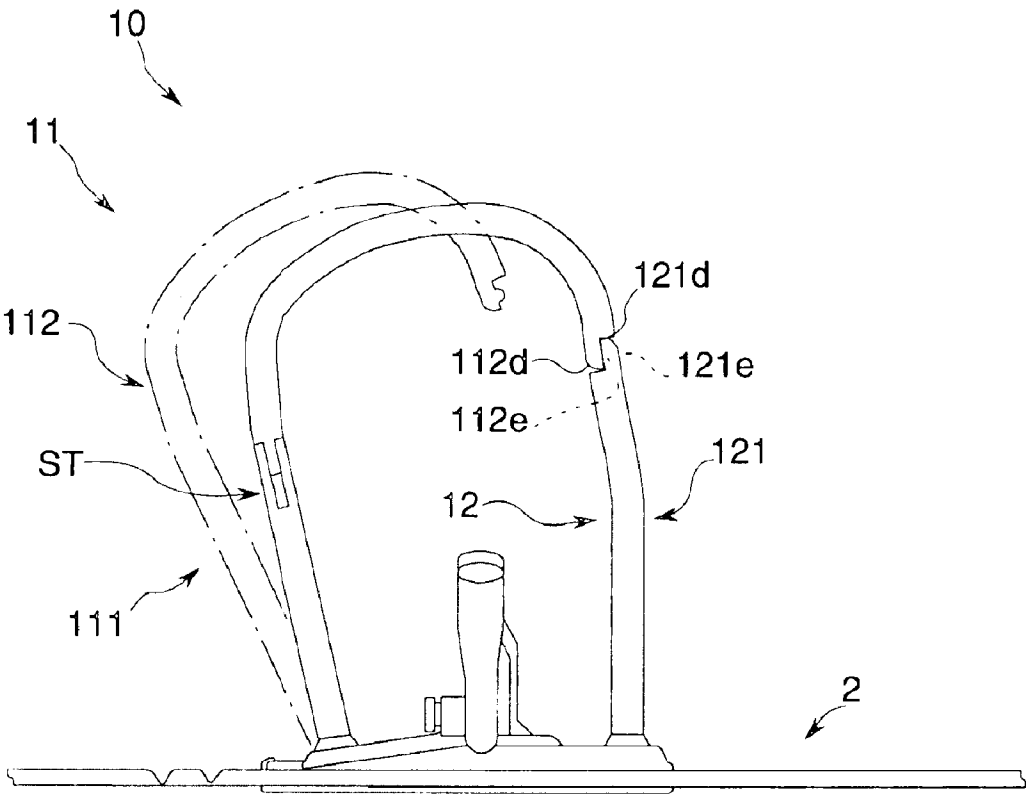
FIG. 9 is a plane view of a part of a file in accordance with another embodiment of the present claimed invention.
Figure 10:
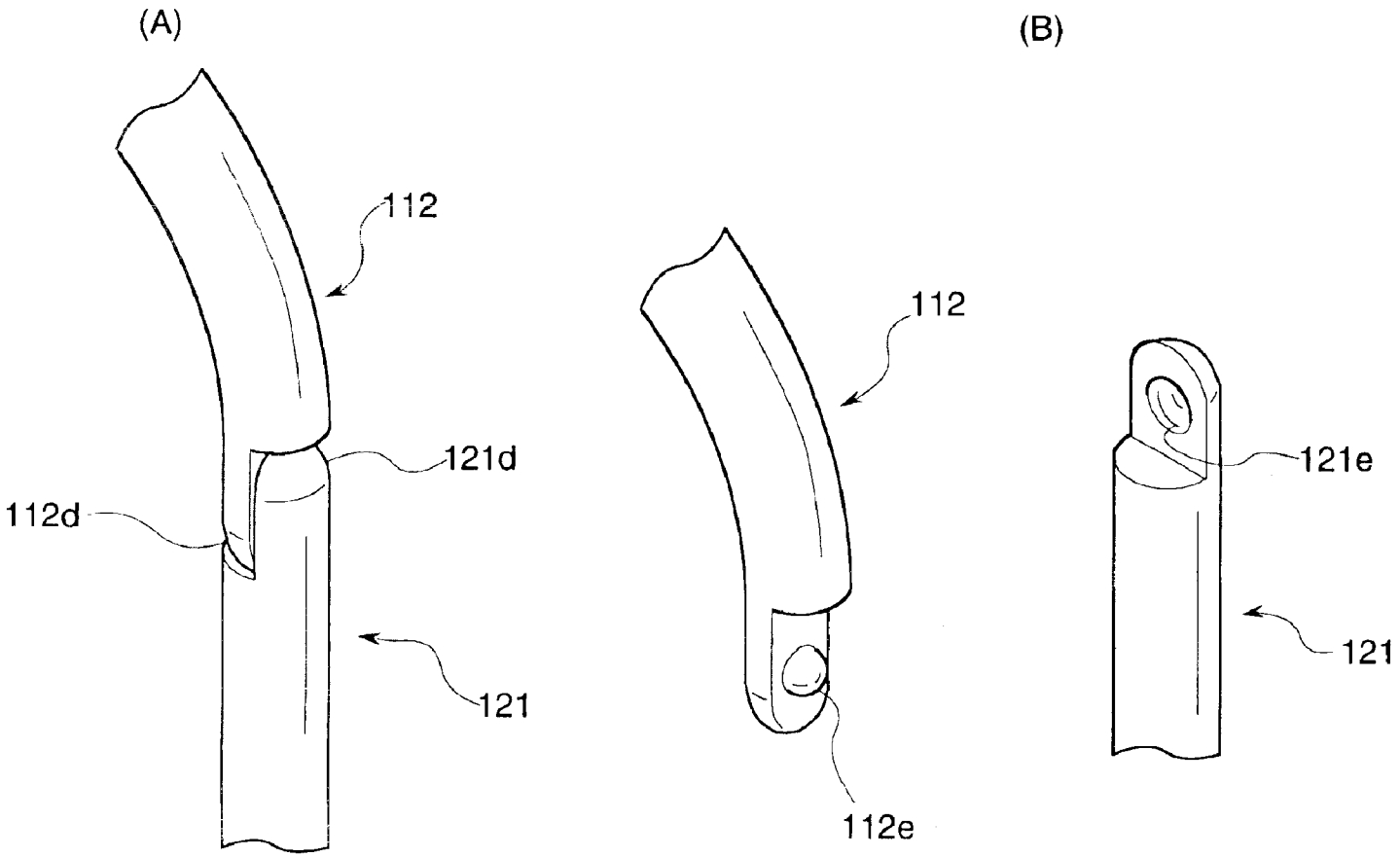
FIG. 10 is a perspective view of a part of a ring-shaped body.
Figure 11:
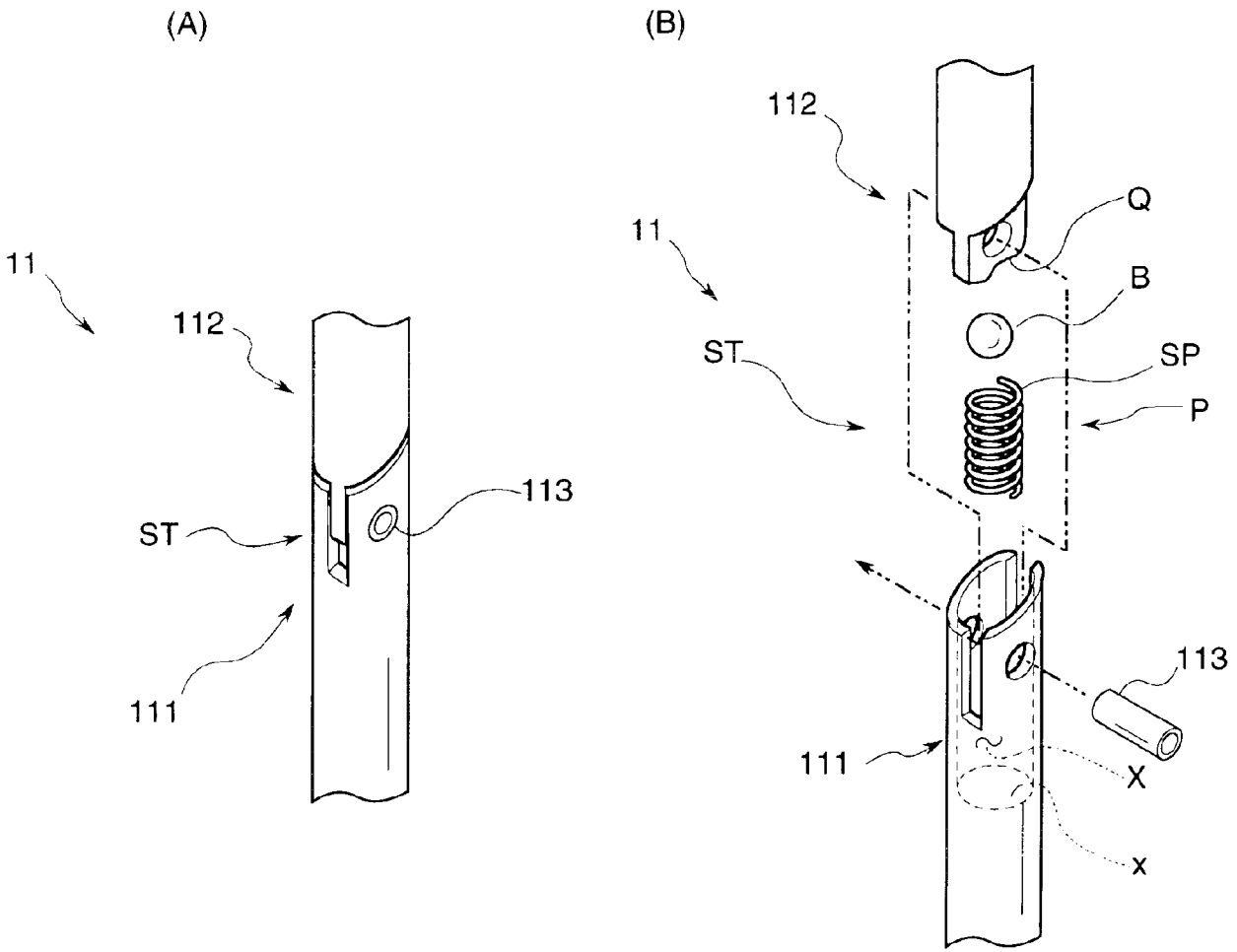
FIG. 11 is a perspective view of a part of the ring-shaped body.

The binding member 10 has generally the same shape and the same arrangement as that of the binding member 1 of the above embodiment except that a first hinge comprises a stopper ST that can lock an arch portion 112 at a standing position R as shown in FIG. 9. In addition, as shown in FIG. 9, FIG. 10(A) and FIG. 10(B), a radius face in a partial sphere shape is formed both at a projecting end 112*d* of the arch portion 112 as a distal end portion of the first ring chip 11 and at a projecting end 121*d* of a standing post portion 121 as a distal end portion of the second ring chip 12 and a relatively rotatable engaging arrangement is established so as to be a second hinge by making use of a projecting portion 112*e* that is a semi-sphere projection as a rotational axis and an axial hole 121*e* that is a concave whose shape corresponds to the shape of the projecting portion 112*e* as a bearing.

The stopper ST arranged on the first hinge is concretely explained with referring to FIG. 11(A) and FIG. 11(B). The stopper ST comprises a pushing portion P arranged in a standing post portion 111 side as one of the members constituting the first ring-shaped body 11 and a surface of an end portion including a concave portion Q of the arch portion 112 as the other member, and the pushing portion P locks the arch portion 112 at the standing position R by inserting a distal end of the pushing portion P into the concave portion Q with applying a pushing force from the pushing portion P to the arch portion 112. The pushing portion P comprises a coiled spring SP as an elastic member whose one end is supported by a bottom portion x of a setting space X that is arranged in the standing post portion 111 and shown by a broken line in FIG. 11(B) and a spherical body B as an abutting member set at the other end side of the coiled spring SP.

Figure 12:
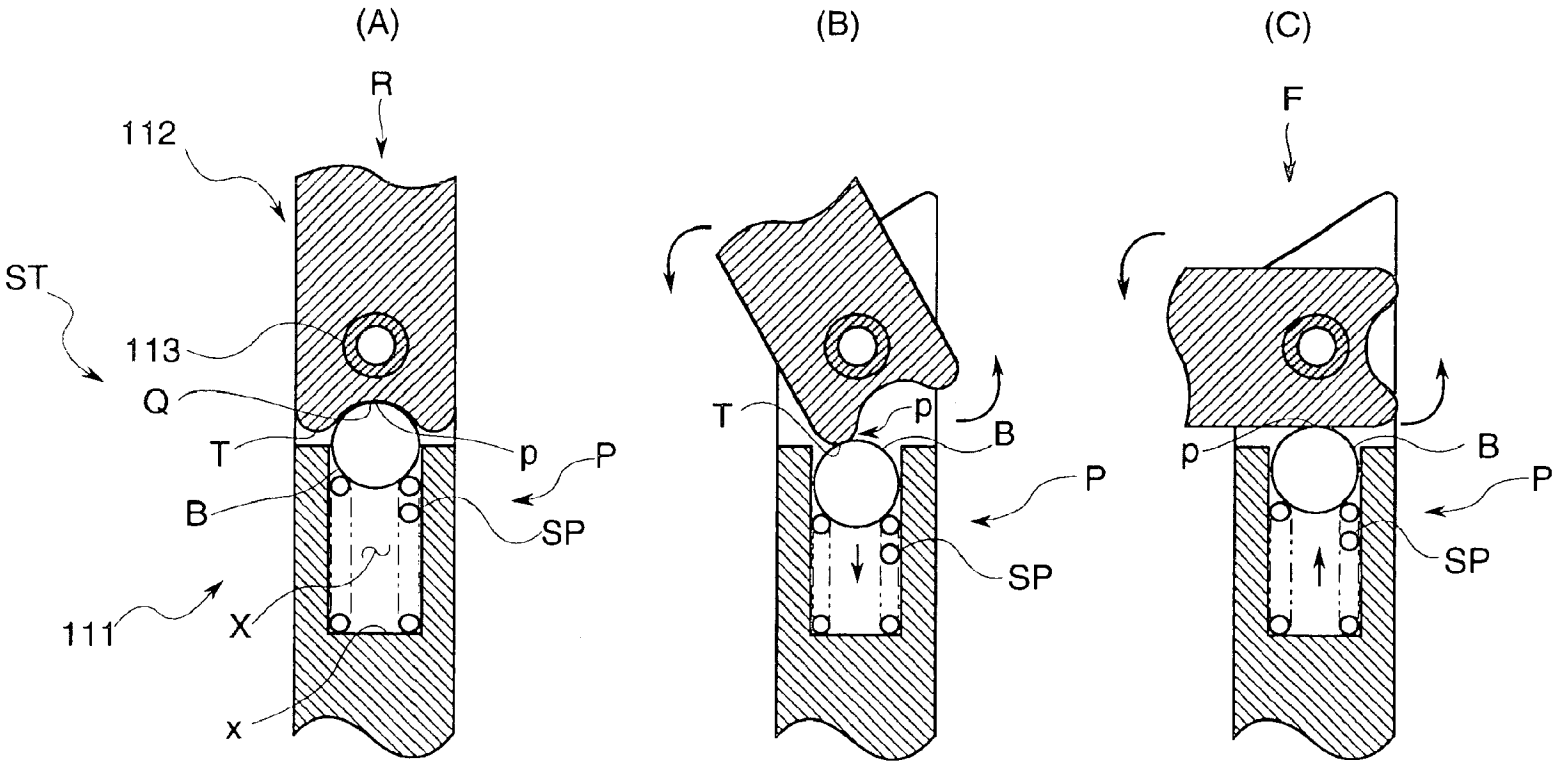
FIG. 12 is a cross-sectional view of a part of the ring-shaped body.
Figure 13:
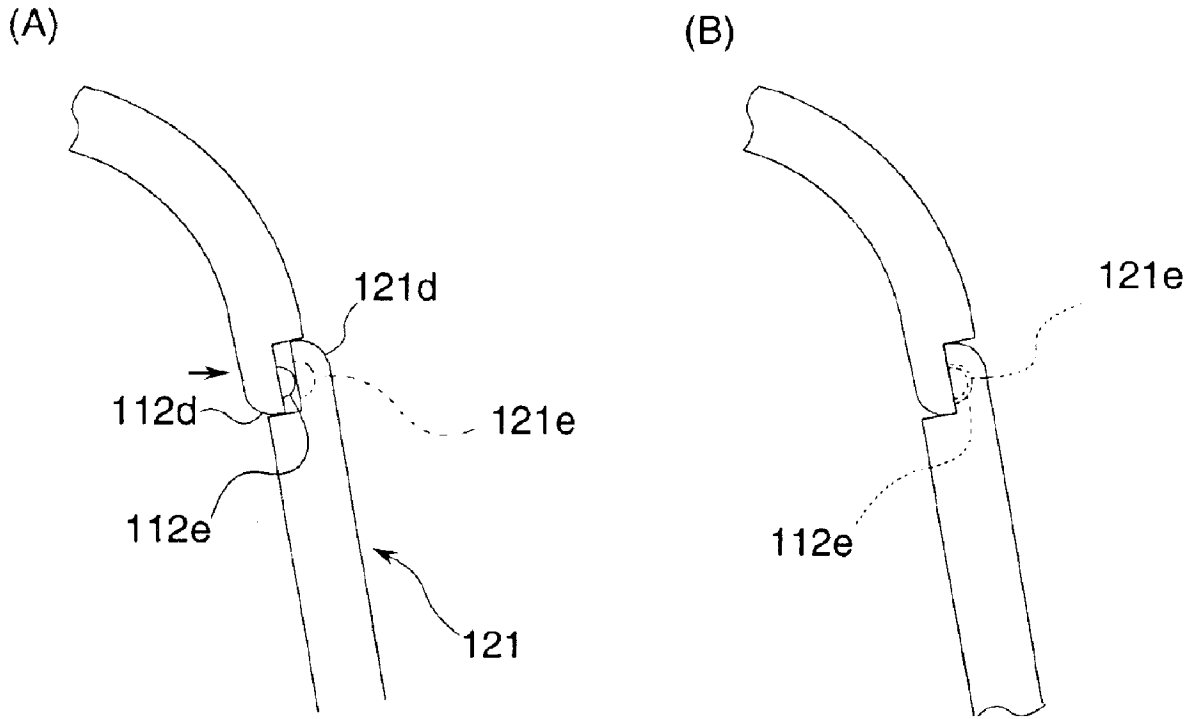
FIG. 13 is a plane view of a part of the ring-shaped body.

As shown in FIG. 12 as a side cross-sectional view, when the arch portion 112 is at the standing position R (FIG. 12(A)), the spherical body B is in a state that a contact position p locates at the concave portion Q locating at the end portion of the arch portion 112 with elastically urged by the coiled spring SP. When the arch portion 112 is inclined from the standing position R, the contact position p moves on the surface of the end portion of the arch portion 112 as shown in FIG. 12(B). By the time the contact position p reaches a convex portion T adjoining the concave portion Q, the end portion of the arch portion 112 pushes the pushing portion P so that the coiled spring SP is compressed by a force, which is felt like a resistance for a user of the file. When the arch portion 112 is further inclined so as to reach an inclined position F, the contact position p climbs over the convex portion T and then moves to a side face of the second ring chip 12 and the coiled spring SP extends as shown in FIG. 12(C). When the coiled spring SP extends, the above-mentioned resistance disappears and operational feeling becomes light at once. A series of movement while the contact position p climbs over the convex portion T gives the user a comfortable click feeling by changing a condition of the coiled spring SP from a compressed state to an extended state. While changing a state from the inclined position F to the standing position R, the same click feeling is given to the user by a movement that the contact position p climbs over the convex portion T and a force to extend the coiled spring SP leads the arch portion 112 to the standing position R as a locked state when the contact position p moves from the convex portion T toward the concave portion Q.

The second hinge of this embodiment constitutes an engaging arrangement in which the projecting end 112*d* as the distal end portion of the first ring chip 11 makes a sliding movement with keeping a condition to contact the standing post portion 121 so that the projecting portion 112*e* is lead toward the axial hole 121*e* as shown in FIG. 13(A) when the space between the ring chips 11 and 12 is closed. Even though the projecting portion 112*e* is lead toward the axial hole 121*e* in a rather misaligned state, the half spherical projecting portion 112*e* whose distal end portion is treated to form a spherical surface is introduced to an inside of the axial hole 121*e* with keeping a contact with the axial hole 121*e* as shown in FIG. 13(B). This arrangement makes it possible for the projecting portion 112*e* to be released from the axial hole 121*e* with ease in case the ring chips 11 and 12 are released to open the space between the ring chips 11 and 12.

For the file wherein the binding member 10 constituting the ring-shaped body for filing papers or leaves is mounted on the cover sheet body 2, the stopper ST that keeps the first hinge at a predetermined angle is arranged so as to lock the first hinge. In accordance with the arrangement, a situation such that the arch portion 112 as the distal end portion of the ring-shaped body locating ahead of the hinge is unexpectedly inclined or stands unexpectedly can be avoided and papers or leaves can be stored effectively and handled preferably as well.

Since the stopper ST comprises the pushing portion P arranged on the standing post portion 111 as one of the members constituting the ring-shaped body through the first hinge and a surface of the arch portion 112 as the other member on which the concave portion Q is arranged wherein the pushing portion P retains the angle of the first hinge by being inserted into the concave portion Q with applying a pushing force to the surface of the arch portion 112, it is possible to set an angle of locking the hinge at discretion by appropriately setting the position of the concave portion Q. In addition, since a locked state is released when a force above a certain level is applied in a locked state with the pushing portion P making a sliding movement on the surface of the arch portion 112 and deflecting from the concave portion Q, it is possible for a user to lock or unlock the hinge preferably.

The stopper ST has the concave portion Q at the end portion of the arch portion 112 as the other member and the ring-shaped body is retained at the standing position R by inserting the pushing portion P into the concave portion Q in order to lock the first hinge at the standing position R in an orthotropic state. With this arrangement, the first hinge can be moved from the standing position R as the orthotropic state to the inclined position F as a bent state and vice versa with a less force compared with a case wherein an arrangement to retain the angle of the hinge by making use of friction between members is adopted. In addition, there is no possibility of failing to retain the standing position R because of abrasion of contact portions due to continuous use and it is possible to lock the arch portion 112 as the other member preferably in spite of continuous use.

Further, the pushing portion P constituting the stopper ST comprises the elastic member and the abutting member wherein one side of the elastic member is fixed to a predetermined portion of the standing post portion 111 and the other side thereof supports the abutting member and the abutting member makes an abutting contact with the arch portion 112 as the other member. With this arrangement, it is possible to make an elastic strength of the elastic member and a shape of the abutting member appropriate by setting up the elastic member and the abutting member respectively. Further, a strength of retaining the hinge, in other word a strength of locking can be set appropriately by setting up a shape of the concave portion Q arranged on the arch portion 112. More concretely, since the coiled spring SP is used as the elastic member, it is possible to set up an elastic strength appropriately by setting up a specification of the coiled spring SP at discretion. In addition, since the spherical body B is used as the elastic member, not only it is easy to mount the abutting member at the end portion of the coiled spring SP but also it is possible to receive a pushing force stably with which the arch portion 112 pushes the pushing portion P and to transfer the force to the coiled spring SP preferably when inclining the arch portion 112 even though a direction of the force changes.

The second hinge in accordance with this embodiment is so arranged that the distal end portion of the projecting portion 112*e* is treated to be sphere in a semi-spherical shape in order to make positioning preferably so as to insert the projecting portion 112*e* into the axial hole 121*e*. In addition, the distal end portion of the projecting portion 112*e* and the axial hole 121*e* which are engaged are each other treated to be sphere in order to make a relatively rotational movement of the second hinge smooth so as to incline the arch portion 112 preferably.

Further, the projecting end 112*d* of the first ring chip 11 is made to be a radius face in a partial spherical shape in order to guide the projecting portion 112*e* into the axial hole 121*e* preferably when closing the space between the ring chips 11 and 12. In addition, since the projecting ends 112*d* and 121*d* of a radius face in a partial spherical shape are arranged on both ring chips 11 and 12 respectively, the second hinge is difficult to get stuck with a hole provided on papers or leaves so that papers or leaves can be dealt preferably when the binding member 10 is at the standing position R and the binding member 10 is difficult to get stuck with a finger of a user or other object when the binding member 10 is at the inclined position F or the space between the ring chips 11 and 12 is open.

The present claimed invention is not limited to the above-described embodiment. For example, a shape of the standing post portion or the arch portion of the ring chip is not limited to the embodiment. The arch portion may be in a bent shape. In addition, a concrete arrangement of the hinge is not limited to the above embodiment. It is a matter of course that either the stopper arranged on the second hinge or the stopper arranged on both of the first hinge and the second hinge belongs to a technical scope of the present claimed invention.

The other concrete arrangement of the component is not limited to the embodiment described in drawings and there may be various modifications without departing from the spirit of the invention.

As mentioned above, in accordance with the present claimed invention, it is possible to provide a ring file that can preferably file much more sheet of papers or leaves. A conventional ring file is requited to set a width of the scoop with considering a dimension of a distal end portion of the ring-shaped body, in other words, a dimension of the arch portion. However, in accordance with the present claimed invention, a width of the scoop can be smaller due to an arrangement in which the arch portion can be made inclinable, thereby to improve efficiency of filing papers with a compact file.

What is claimed is:

1. A file for papers or leaves comprising a cover sheet body and a binding member comprising a ring-shaped body, wherein the ring-shaped body is mounted on the cover sheet body, wherein the ring-shaped body comprises first and second hinges at predetermined positions, the predetermined positions being located away from the top of the ring-shaped body, wherein a portion ahead of the hinges of the ring-shaped body can incline, wherein the ring-shaped body comprises first and second openable and closable ring chips and each distal end portion of the ring chips is engaged to close a space between the ring chips, wherein the first hinge is arranged on the first ring chip and the second hinge comprises an engaging arrangement to engage a distal end portion of the first ring chip with the second ring chip in a relatively rotatable manner.

2. The file described in claim 1 wherein the distal end portion of one of the first and second ring chips comprises a projecting portion that projects toward the distal end portion of the other of the first and second ring chips when the space between the ring chips is closed, the distal end portion of the other ring chip comprises an axial hole that accommodates the projecting portion when the space between the ring chips is closed, and each distal end portion of the ring chips is relatively rotatable by a concavo-convex engagement of the projecting portion and the axial hole wherein the projecting portion provides a rotational axis and the axial hole provides a bearing.

3. The file described in claim 2 wherein at least a part of an inner face of the axial hole has a notch so that an opening edge of the axial hole expands toward a direction to which the ring chips open or close.

4. The file described in claim 2 wherein the distal end portion of the projecting portion is a sphere.

5. The file described in claim 2 wherein the projecting end of one of the ring chips has a radius face in a partial sphere shape.

6. The file described in claim 2 wherein the projecting end of each ring chip has a radius face in a partial sphere shape.

7. A file for papers or leaves comprising a cover sheet body and a binding member comprising a ring-shaped body, wherein the ring-shaped body is mounted on the cover sheet body, wherein the ring-shaped body comprises first and second hinges at predetermined positions, and wherein a portion ahead of the hinges of the ring-shaped body can incline, and further comprising a stopper to retain an angle of the hinge and to maintain the portion ahead of the hinge in an inclined position.

8. The file described in claim 7 wherein the cover sheet body includes a rear cover sheet having an inner face on which the binding member is mounted, a scroop continuing to the rear cover sheet, and a front cover sheet continuing to the scroop and facing to the rear cover sheet, and wherein the front cover sheet has an opening that allows the portion ahead of the hinges of the ring-shaped body to pass when the portion is not inclined and prevents the portion ahead of the hinge of the ring-shaped body from passing when the portion is inclined.

9. The file described in claim 8 wherein the hinges are arranged at a position separated from the inner face of the rear cover sheet by a distance generally corresponding to a width of the scroop.

10. A file for papers or leaves comprising a cover sheet body and a binding member comprising a ring-shaped body, wherein the ring-shaped body is mounted on the cover sheet body, wherein the ring-shaped body comprises first and second hinges at predetermined positions, and wherein a portion ahead of the hinges of the ring-shaped body can incline, wherein one hinge connects first and second members of the ring-shaped body and comprises a stopper to retain an angle of the hinge;

wherein the stopper comprises a pushing portion arranged on the first member, and a surface of the second member has a concave portion, and the pushing portion retains the angle of the hinge by insertion into the concave portion by applying a pushing force to the surface of the second member.

11. The file described in claim 10 wherein the stopper has the concave portion at an end portion of the second member and retains the angle of the hinges in an orthotropic condition by inserting the pushing portion into the concave portion.

12. The file described in claim 10 wherein the pushing portion comprises an elastic member and an abutting member, one portion of the elastic member is fixed to a predetermined position on one of the first and second members and the other portion of the elastic member supports the abutting member, and the abutting member makes an abutting contact with the other of the first and second members.

13. The file described in claim 12 wherein the elastic member comprises a coiled spring and the abutting member comprises a spherical body.

14. A file for papers or leaves comprising a cover sheet body and a binding member comprising a ring-shaped body, wherein the ring-shaped body is mounted on the cover sheet body, wherein the ring-shaped body comprises first and second hinges at predetermined positions, and wherein a portion ahead of the hinges of the ring-shaped body can incline, wherein the ring-shaped body comprises a pair of standing post portions extending generally vertically to a mounting face of the cover sheet body on which the binding member is mounted and a curved or bent arch portion to connect each of the distal ends of the standing post portions, and the hinges are arranged at boundaries between each standing post portions and the arch portion respectively.

15. The file described in claim 14 wherein at least one of the standing post portions extends in a linear manner.

16. A binding member comprising a ring-shaped body and a pair of hinges at predetermined positions on the ring-shaped body, the predetermined positions being located away from the top of the ring-shaped body, wherein a portion ahead of the hinges of the ring-shaped body can incline, wherein the ring-shaped body comprises first and second openable and closable ring chips and each distal end portion of the ring chips is engaged to close a space between the ring chips, wherein the first hinge is arranged on the first ring chip and the second hinge comprises an engaging arrangement to engage a distal end portion of the first ring chip with the second ring chip in a relatively rotatable manner.

17. The binding member described in claim 16 wherein the distal end portion of one of the first and second ring chips comprises a projecting portion that projects toward the distal end portion of the other of the first and second ring chips when the space between the ring chips is closed, the distal end portion of the other ring chip comprises an axial hole that accommodates the projecting portion when the space between the ring chips is closed, and each distal end portion of the ring chips is relatively rotatable by a concavo-convex engagement of the projecting portion and the axial hole wherein the projecting portion provides a rotational axis and the axial hole provides a bearing.

18. The binding member described in claim 17 wherein at least a part of an inner face of the axial hole has a notch so that an opening edge of the axial hole expands toward a direction to which the ring chips open or close.

19. The binding member described in claim 17 wherein the distal end portion of the projecting portion is a sphere.

20. The binding member described in claim 16 wherein the projecting end of one of the ring chips has a radius face in a partial sphere shape.

21. The binding member described in claim 16 wherein the projecting end of each ring chip has a radius face in a partial sphere shape.

22. A binding member comprising a ring-shaped body and a pair of hinges at predetermined positions on the ring-shaped body, wherein a portion ahead of the hinges of the ring-shaped body can incline, and further comprising a stopper to retain an angle of the hinge and to maintain the portion ahead of the hinge in an inclined position.

23. A binding member comprising a ring-shaped body and a pair of hinges at predetermined positions on the ring-shaped body, wherein a portion ahead of the hinges of the ring-shaped body can incline, and further comprising a stopper to retain an angle of the hinge;

wherein the stopper comprises a pushing portion arranged on the first member and a surface of the second member has a concave portion, and the pushing portion retains the angle of the hinge by insertion into the concave portion by applying a pushing force to the surface of the second member.

24. The binding member described in claim 23 wherein the stopper has the concave portion and retains the angle of the hinges in an orthotropic condition by inserting the pushing portion into the concave portion.

25. The binding member described in claim 23 wherein the pushing portion comprises an elastic member and an abutting member, one portion of the elastic member is fixed to a predetermined position on one of the first and second members and the other portion of the elastic member supports the abutting member, and the abutting member makes an abutting contact with the other of the first and second members.

26. The binding member described in claim 25 wherein the elastic member comprises a coiled spring and the abutting member comprises a spherical body.

27. A binding member comprising a ring-shaped body and a pair of hinges at predetermined positions on the ring-shaped body, wherein a portion ahead of the hinges of the ring-shaped body can incline, wherein the ring-shaped body comprises a pair of standing post portions extending generally vertically to a mounting face of the cover sheet body on which the binding member is mounted and a curved or bent arch portion arranged to connect each distal end of the standing post portions, and the hinges are arranged at boundaries between each standing post portions and the arch portion respectively.

28. The binding member described in claim 27 wherein at least one of the standing post portions extends in a linear manner.

* * * * *

UNITED STATES PATENT AND TRADEMARK OFFICE

CERTIFICATE OF CORRECTION

PATENT NO. : 6,913,408 B2
DATED : July 5, 2005
INVENTOR(S) : Nobuaki Tsujino

It is certified that error appears in the above-identified patent and that said Letters Patent is hereby corrected as shown below:

Column 11,
Lines 56 and 59, "claim 2" has been replaced with -- claim 1 --.

Signed and Sealed this

Eleventh Day of April, 2006

JON W. DUDAS
*Director of the United States Patent and Trademark Office*